United States Patent [19]

Ushiyama

[11] Patent Number: 4,957,292

[45] Date of Patent: Sep. 18, 1990

[54] LOOP TRANSFER GAME DEVICE

[76] Inventor: Yasuhiro Ushiyama, OX Co., Ltd. c/o, 6-7, Furujin-machi, Takamatsu-City, Kagawa, Japan

[21] Appl. No.: 463,206

[22] Filed: Jan. 10, 1990

[30] Foreign Application Priority Data

Apr. 25, 1989 [JP] Japan ..... 1-106943

[51] Int. Cl.[5] ..... A63F 9/08

[52] U.S. Cl. ..... 273/159; 273/158; 272/113

[58] Field of Search ..... 273/158, 159; 272/113

[56] References Cited

U.S. PATENT DOCUMENTS

| | | | |
|---|---|---|---|
| D. 272,455 | 1/1984 | Eakin | 273/158 |
| 4,221,386 | 9/1980 | Wisniewski | 273/159 |
| 4,391,445 | 7/1983 | Vizelyi | 273/158 |

OTHER PUBLICATIONS

"Games and Puzzles", Dec., 1976, p. 35, Puzzles shown in article titled Solid Gold.

*Primary Examiner*—William H. Grieb
*Assistant Examiner*—W. Pierce
*Attorney, Agent, or Firm*—Armstrong, Nikaido, Marmelstein, Kubovcik & Murray

[57] ABSTRACT

A loop transfer game for transfer of a loop from one pin to the other while remaining looped around one of the pins. A device of the game is provided comprising a first pin mounted on a base member. A second pin connected to the first pin by a first annular obstruction, other obstruction pins and annular obstructions disposed between the first pin, second pin, and first annular obstruction, and a loop made of flexible material, in which for play of a game, the loop can be transferred from the first pin to the second pin and vice versa through a series of the obstruction pins and annular obstructions while remaining in the engagement.

3 Claims, 13 Drawing Sheets

LOOP TRANSFER GAME DEVICE

BACKGROUND OF THE INVENTION

The present invention relates to a loop transfer game device with a loop transferred from one pin to the other pin while remaining looped around one of the pins.

There has been known a similar game device such as a puzzle ring. The puzzle ring is provided having at least two or more links connected together in intricate arrangement for allowing the player to puzzle out to separate the links from each other.

The puzzle ring is arranged for separation of the intricately connected links from each other through unlocking movements and thus, to allow each player to play in both his hands using his fingers but not body. It is however disadvantageous that as the game is rather oriented towards so-called brain training, each player can hardly cooperate through physical action and share the pleasure of amusement with other players. It is possible that the puzzle ring becomes useless when one or more of its separated links are inadvertently lost and thus, will be improper for use as a public instrument or installation.

SUMMARY OF THE INVENTION

The present invention is directed in view of the foregoing problems towards an improved game device in which the first improvement comprises a first pin mounted on a base member, a second pin connected to the first pin by a first annular obstruction, a first obstruction pin extending through the inside of the first annular obstruction and having a second annular obstruction mounted to the distal end thereof, a second obstruction pin extending through the inside of the second annular obstruction, and a loop made of flexible material and provided encircling either the first or second pin, and the second improvement comprises a first pin mounted on a base member, a second pin mounted on the base member and connected to the first pin by a first annular obstruction, a couple of third and fourth obstruction pins fixedly mounted to the first annular obstruction, a couple of third and fourth annular obstructions mounted to the distal ends of the third and fourth obstruction pins respectively, a couple of fifth and sixth obstruction pins extending through the insides of the third and fourth annular obstructions respectively, and a loop made of flexible material and provided encircling either the first or second pin. The latter may include a seventh obstruction pin extending through the inside of the first annular obstruction.

In playing the game, the loop is transfered from the first pin to the second pin and vice versa through the annular obstructions and the obstruction pins while remaining looped around the pins. The game will be appreciated in which one player transfers the loop with his skill in a short period of time while another takes much more time. The procedure of transfer of the loop from the first pin to the second pin can be carried out in a similar manner to from the second pin to the first pin. It would be understood that while the transfer from one to the other is readily made, the reverse may be not. It will take a different length of time to complete the transfer when played after a certain period of time.

When the device is made in considerable size for transfer of the loop from one pin or pole to the other, it can be used as a public playing installation with the loop remaining engaged with either the first or second pole to avoid separation while the base member is secured to the ground and remains dislocated. Also, when each components is made of rigid material such as stainless steel and increased in both diameter and length while the base member is constructed with heavily weighted materials such as concrete blocks or the like, the game device can allow players to climb and hang down from its components and thus, enjoy physical exercises as playing a game in a Junglegym-like arrangement.

BRIEF DESCRIPTION OF THE DRAWINGS

FIGS. 1 through 7 illustrate a first embodiment of the first improvement according to the present invention in which FIG. 1 is a perspective view of the entire arrangement while FIGS. 2 to 7 are explanatory views showing the precess of a game;

EMBODIMENTS OF THE INVENTION

Figure 1:
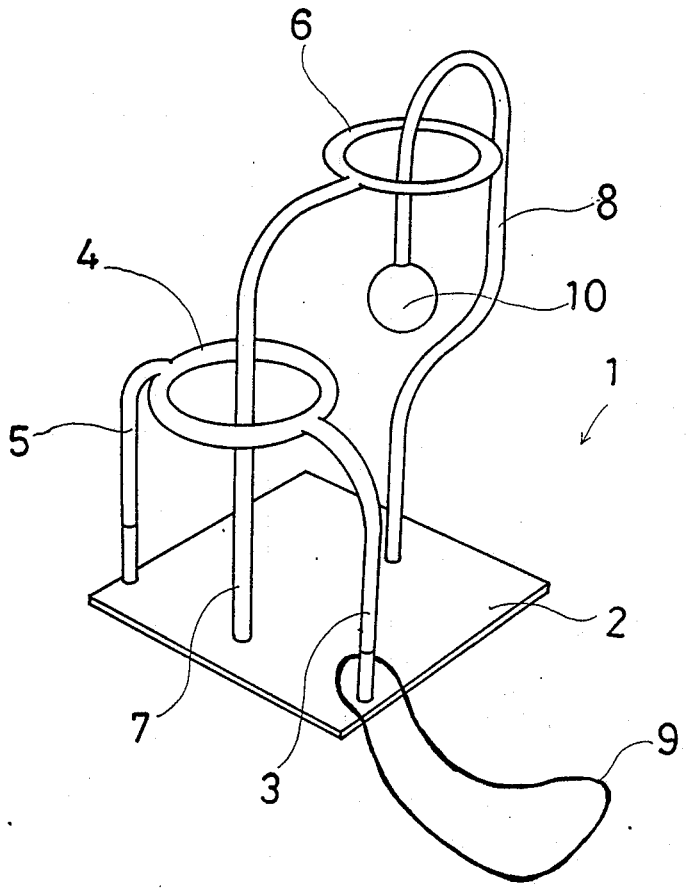
Figure 2:
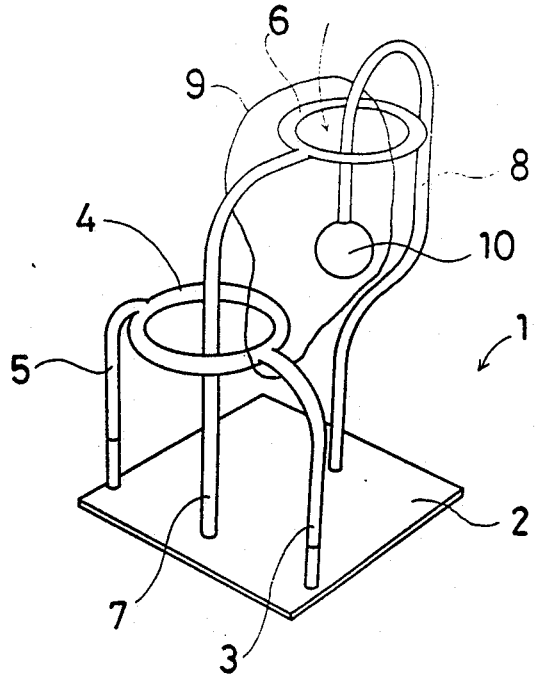

A first embodiment according to the first improvement of the present invention will be described referring to FIG. 1.

The first embodiment is disclosed in the form of a loop transfer game device 1 comprising a first pin 3 mounted on a base member 2, a second pin 5 linked to the first pin 3 by a first annular obstruction 4, a first obstruction pin 7 extending through the inside of the first annular obstruction 4 and having a second annular obstruction 6 mounted to the distal end thereof, a second obstruction pin 8 extending into the second annular obstruction 6, and a loop 9 made of flexible material and provided so as to encircle either the first pin 3 or the second pin 5.

The first annular obstruction 4 which is coupled between the first and second pins 3 and 5 both mounted at the lowermost ends on the base member 2, is shaped of circular, polygonal, or looped form having an empty space in the center. The first obstruction pin 7 is also fixedly mounted at the lowermost end to the base member 2, at the central region, curved and encircled by the first annular obstruction 4, and at the distal end, coupled to the second annual obstruction 6. The second annular obstruction 6 is not limited to a circular form and may be of other shape. The second obstruction pin 8 is curved to extend through the center of the second annular obstruction 6 from the upper to the lower as shown in FIG. 1 and may straightly extend from the lower. For the purpose of improved appearance, a ball 10 is fixedly mounted to the distal end of the second obstruction pin 8. The loop 9 is made of flexible material for folding and twisting and arranged to encircle either the first pin 3 or the second pin 5.

The procedure of game play with the loop transfer game device 1 of the first embodiment will then be described.

The game with the loop transfer game device 1 is designed for playing by transferring the loop 9 from one pin to the other via the first annular obstruction 4, first obstruction pin 7, second annular obstruction 6, and second obstruction pin 8.

Figure 3:
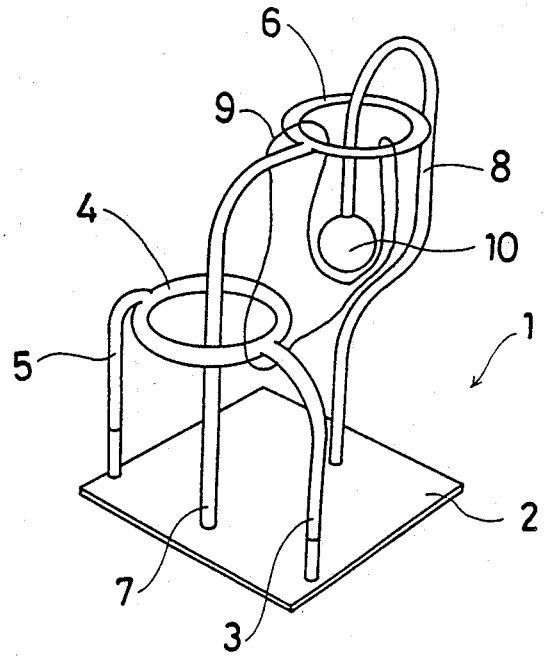
Figure 4:
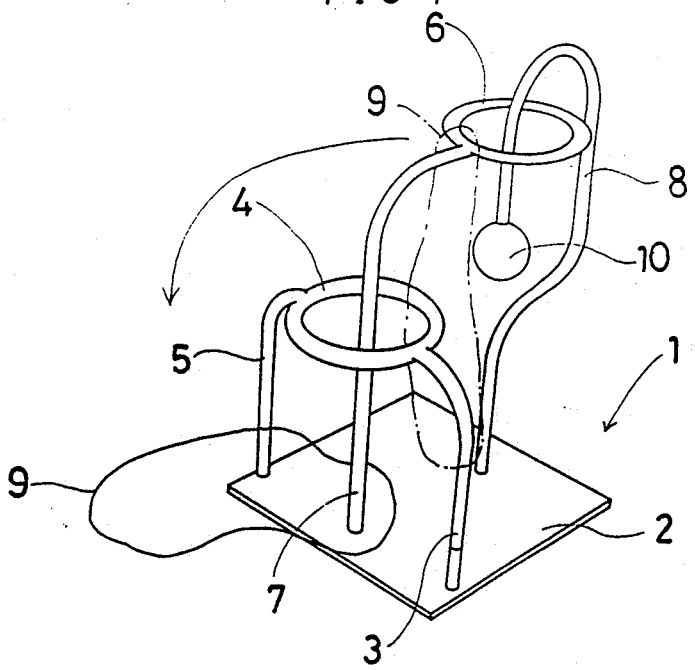
Figure 5:
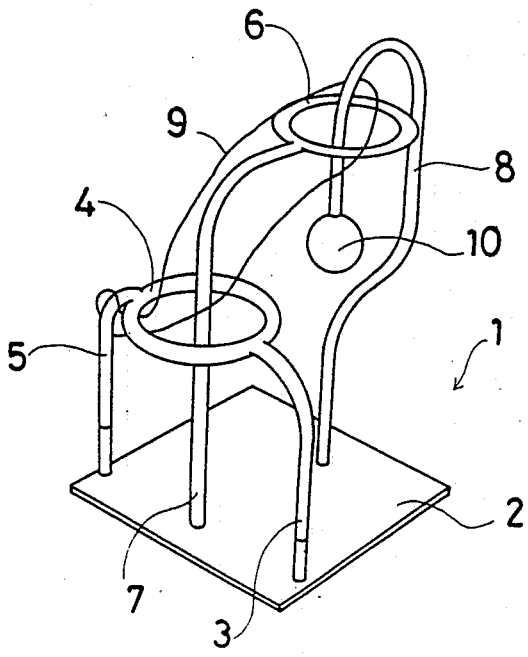
Figure 6:
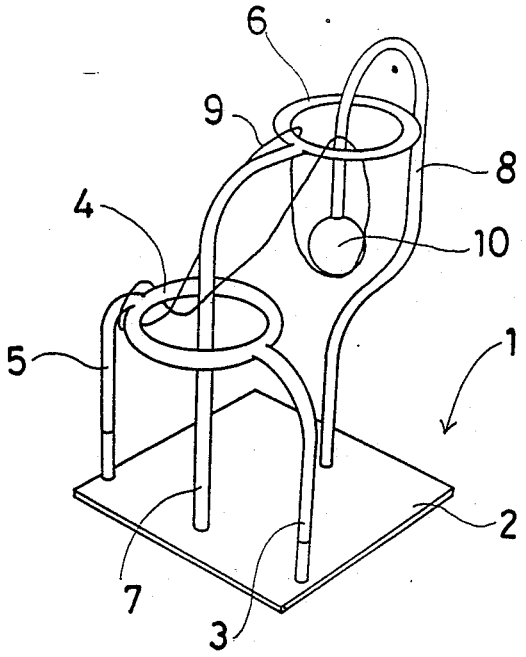
Figure 7:
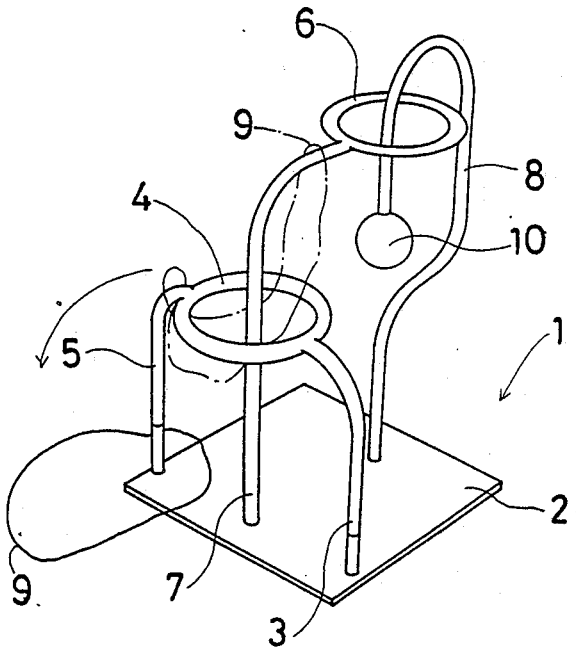

The description will be made with the loop 9 being transferred from the first pin 3 to the second pin 5. First, the loop 9 is stretched out to pass the second annular obstruction 6. Since being interrupted by the second obstruction pin 8, the forward end of the loop 9 passes beneath the ball 10 as shown in FIG. 3. When pulled down, the loop 9 extends between the second pin 5 and the first obstruction pin 7 as shown in FIG. 4. As shown in FIG. 5, the loop 9 is passed in the first annular obstruction 4 with its forward end clearing the distal end of the second annular obstruction 6 so that it can disengage from the first obstruction pin 7. At the time, the forward end of the loop 9 is also passed beneath the ball 10, as shown in FIG. 6, to avoid the interruption of the second obstruction pin 8. As been pulled down, the loop 9 passes through the second and first annular obstructions 6 and 4 and then, clears the first obstruction pin 7 to be located about the the second pin 5 as shown in FIG. 7. Thus, the game is over. If the game is primarily determined to continue a reverse action of transferring the loop 9 back to the first pin 3, a return play can start at the same moment.

Figure 8:
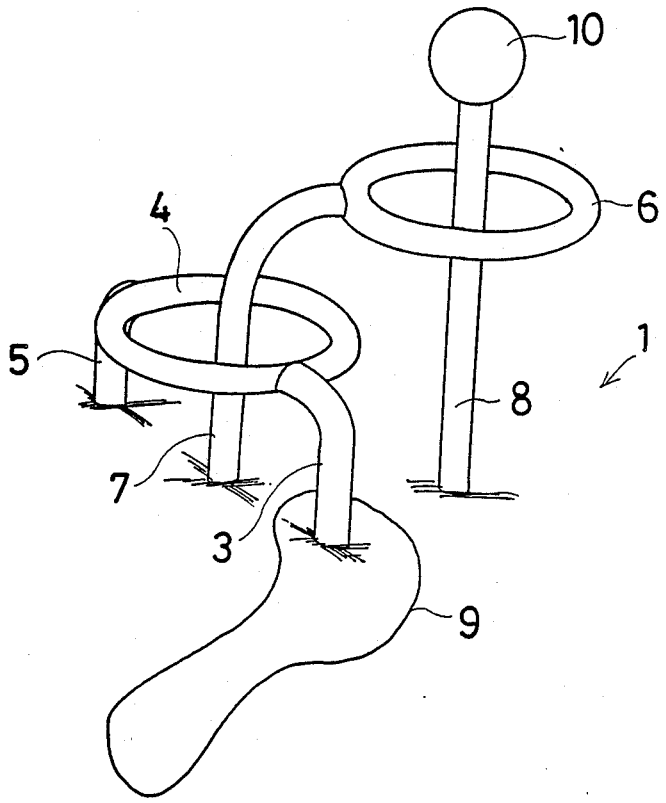
FIG. 8 illustrates a second embodiment of the first improvement.

A second embodiment according to the first improvement of the present invention is shown in FIG. 8 in which the second obstruction pin 8 extends through the center of the second annular obstruction from the lower to the upper as compared with from the upper to the lower in the first embodiment.

Figure 9:
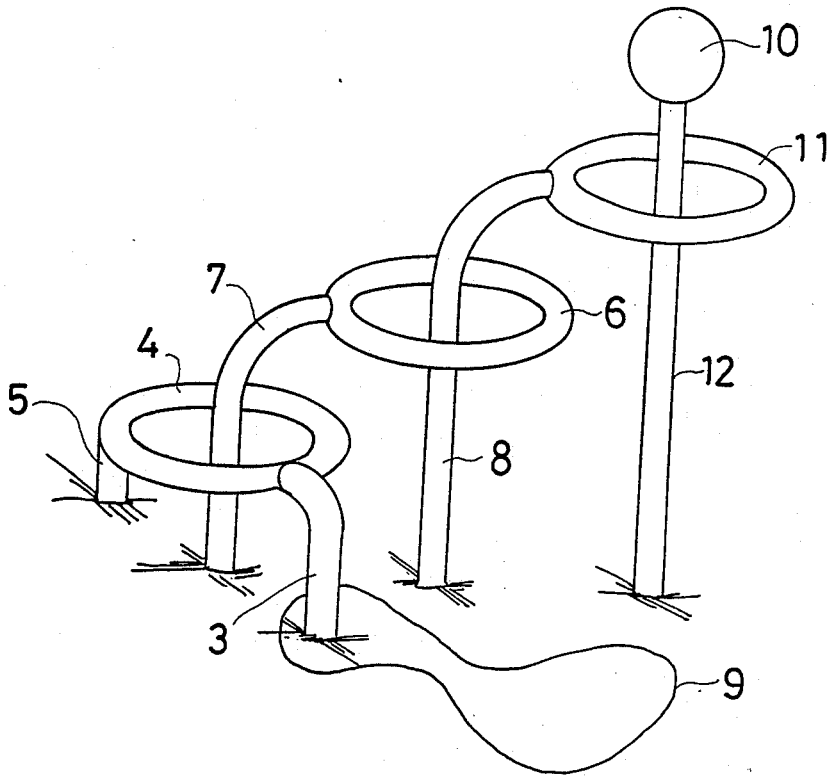
FIG. 9 illustrates a third embodiment of the first improvement.

A third embodiment according to the first improvement of the present invention is also shown in FIG. 9. The difference from the first embodiment is that the second obstruction pin 8 is curved outwardly of the second annular obstruction 6 and has at the distal end a third annular obstruction 11 across which a third obstruction pin 12 extends from the lower to the upper.

The description of game play with the second or third embodiments will be omitted as is almost equal to that of the first embodiment.

Figure 10:
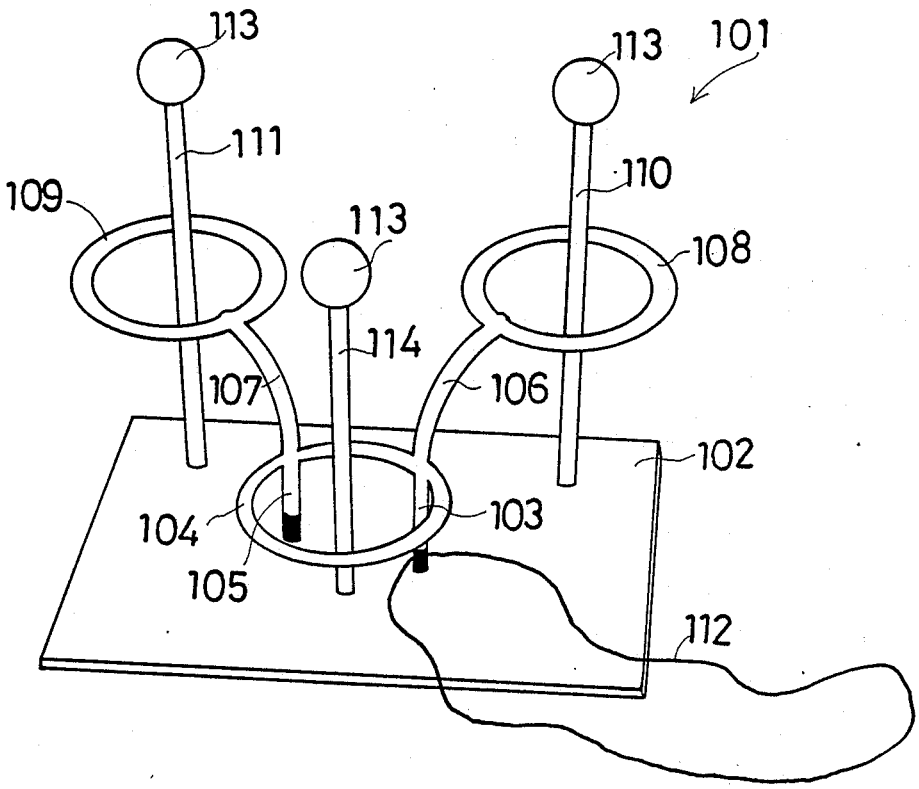
FIGS. 10 through 20 are perspective views of a first embodiment of the second improvement showing the procedure of a game.

A first embodiment according to the second improvement of the present invention will then be described referring to FIG. 10.

The first embodiment of the second improvement is disclosed in the form of another loop transfer game device 101 comprising a first pin 103 mounted on a base member 102, a second pin 105 mounted on the base member 102 and coupled to the first pin 103 by a first annular obstruction 104, a couple of first and second obstruction pins 106 and 107 fixedly mounted to the first annular obstruction 104, a couple of second and third annular obstructions 108 and 109 fixedly mounted to the first and second obstruction pins 106 and 107 respectively, a couple of third and fourth obstruction pins 110 and 111 extending through the insides of the second and third annular obstructions 108 and 109 respectively, and a loop 112 made of flexible material and provided encircling either the first pin 103 or the second pin 105.

Both of the first and second pins 103, 105 are fixedly mounted on the base member 102 to extend equally at approximately a right angle to the same and coupled at the uppermost ends to the first annular obstruction 104. The first annular obstruction 104 is not limited to a ring-like form and may be of rectangular, oval or other shape having an empty space in the center. Both of the first and second obstruction pins 106, 107 are fixedly mounted to the upper end of the first annular obstruction 104, curved outwardly of the same, and coupled at the distal end to the second and third annular obstructions 108, 109 respectively. Each of the second and third annular obstructions 108, 109 is not limited to a ring-like form and may be of such a shape as having an empty space in the center as well as the first annular obstruction 104. The third and fourth obstruction pins 110, 111 are both mounted at the lowermost ends to the base member 102 to extend through the insides of the second and third annular obstructions 108, 109 respectively. Each of the third and fourth obstruction pins 110, 111 has at the uppermost end a ball 113 for decorative purpose and may extend across its corresponding annular obstruction from the upper to the lower other then extending straightly from the lower to the upper as shown in FIG. 10.

Also, there may be provided a fifth obstruction pin 114 extending through the center of the first annular obstruction 104.

The procedure of game play with the loop transfer game device 101 will be described.

The loop transfer game device 101 is also arranged for playing a game by transferring the loop 112 from one pin to the other through the obstruction pins and the annular obstructions.

The description will be made with the loop 112 being transferred from the first pin 103, of which preparatory setup is shown in FIG. 10, to the second pin 105.

Figure 11:
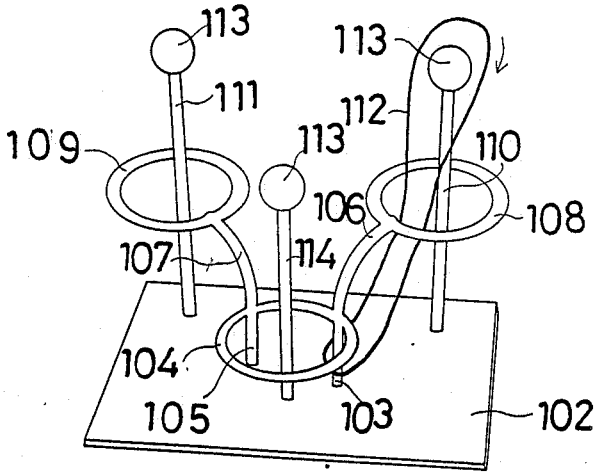
Figure 12:
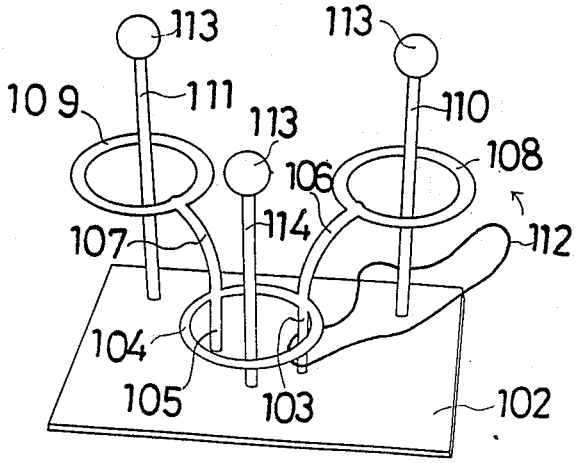
Figure 13:
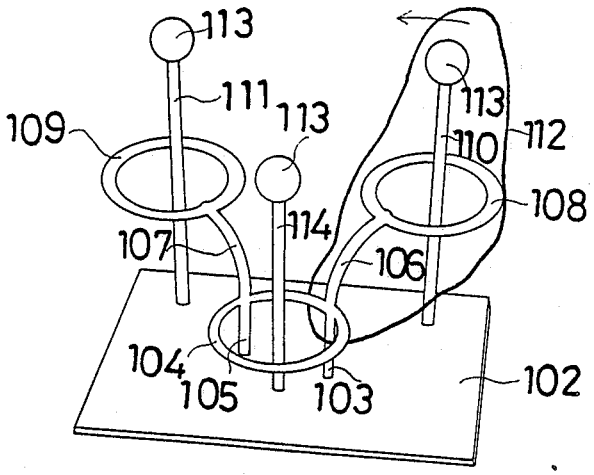
Figure 14:
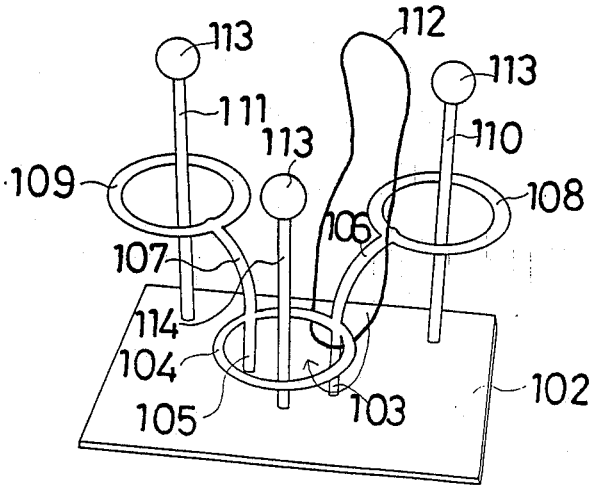
Figure 15:
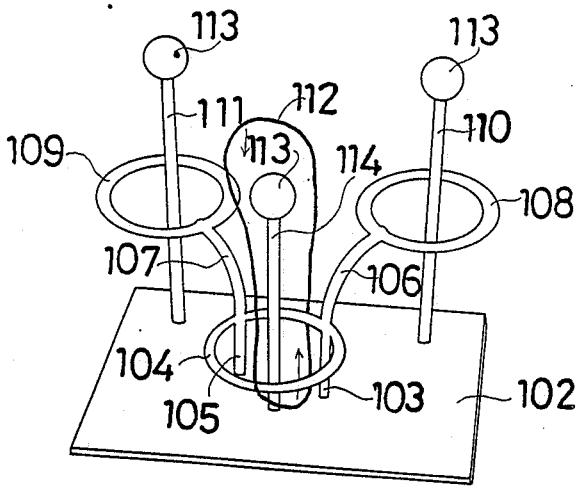
Figure 16:
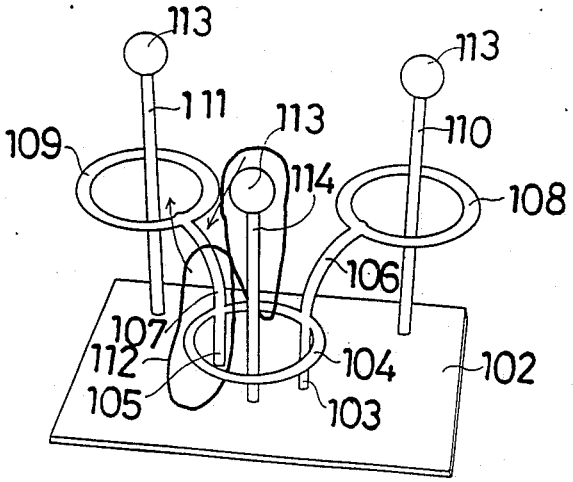
Figure 17:
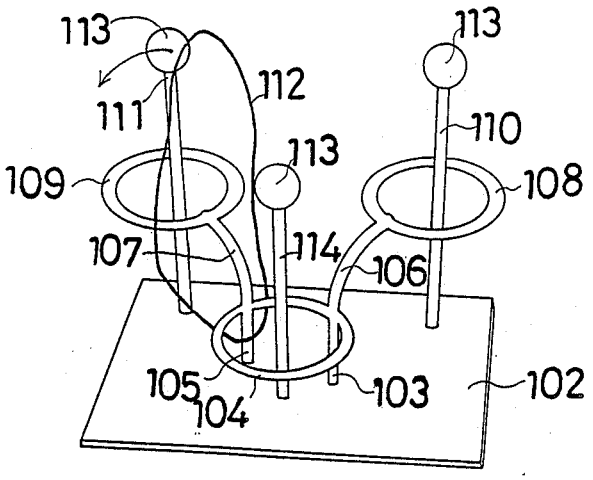
Figure 18:
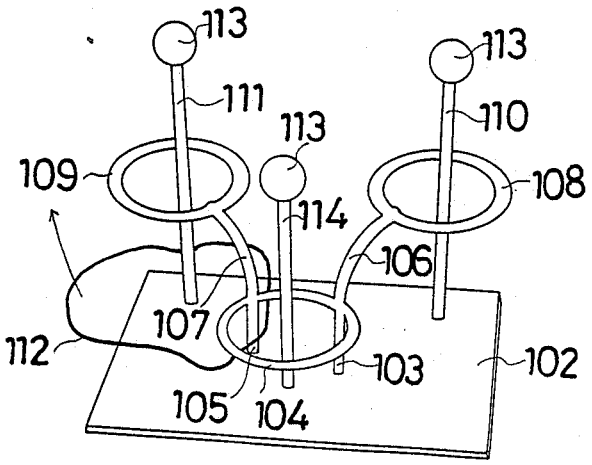
Figure 19:
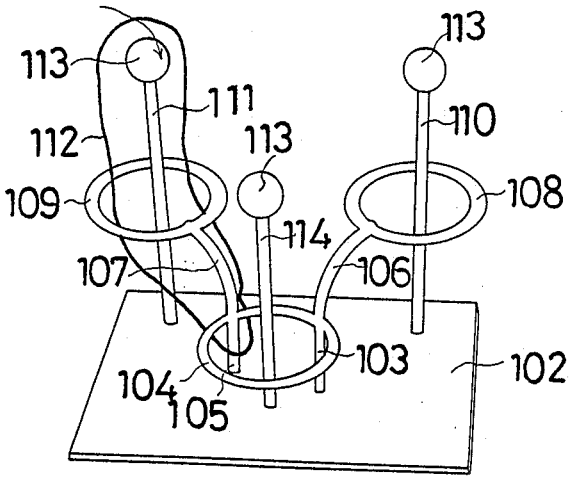
Figure 20:
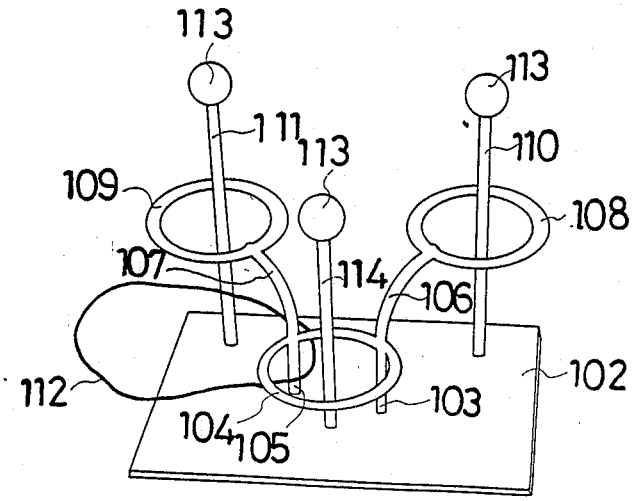

As shown in FIG. 11, the loop 112 is upwardly passed with its forward end lifted through the center of the second annular obstruction 108 to encircle the third obstruction pin 110. When the loop 112 is released, it encircles both the first pin 103 and the third obstruction pin 110 as shown in FIG. 12. Then, the loop 112 is moved to clear the second annular obstruction 108 and the third obstruction pin 110 respectively, and as shown in FIG. 14, hangs down above the first annular obstruction 104 while remaining engaged with the first pin 103 and the first obstruction pin 106. The upper end of the loop 112 is kept above the fifth obstruction pin 114 as shown in FIG. 15 and succeedingly, the lower end of the same is passed across the center of the first annular obstruction 104 through the above the fifth obstruction pin 114 as shown in FIG. 16. Then, as the second obstruction pin 107 still interrupts the transfer of the loop 112 to the second pin 105, the loop 112 is stretched out to clear the fourth obstruction pin 111 and the third annular obstruction 109 as shown in FIG. 17. The loop 112 is shifted from a position shown in FIG. 18 to a position shown in FIG. 19 by upwardly passing through the inside of the third annular obstruction 109. After clearing the fourth obstruction pin 111 and passing off the second obstruction pin 107, the loop 112 is finally located to encircle the second pin 105. Thus, the first transfer is completed.

To transfer the loop 112 from the second pin 105 back to the first pin 103, the procedure of return transfer can be executed in a reverse manner.

Although the first and second obstruction pins 106, 107 are arranged in this embodiment to act as outwardly extending arms for supporting the second and third annular obstructions 108, 109 respectively, they may stand upright on the first annular obstruction 104 with the third and fourth obstruction pins 110, 111 being curved to extend through the insides of the second and third annular obstructions 108, 109 respectively. Also, the second and third annular obstructions 108, 109 may both be coupled directly to the first annular obstruction 104 while the first and second pins 106, 107 are regarded as arms of no length.

Figure 21:
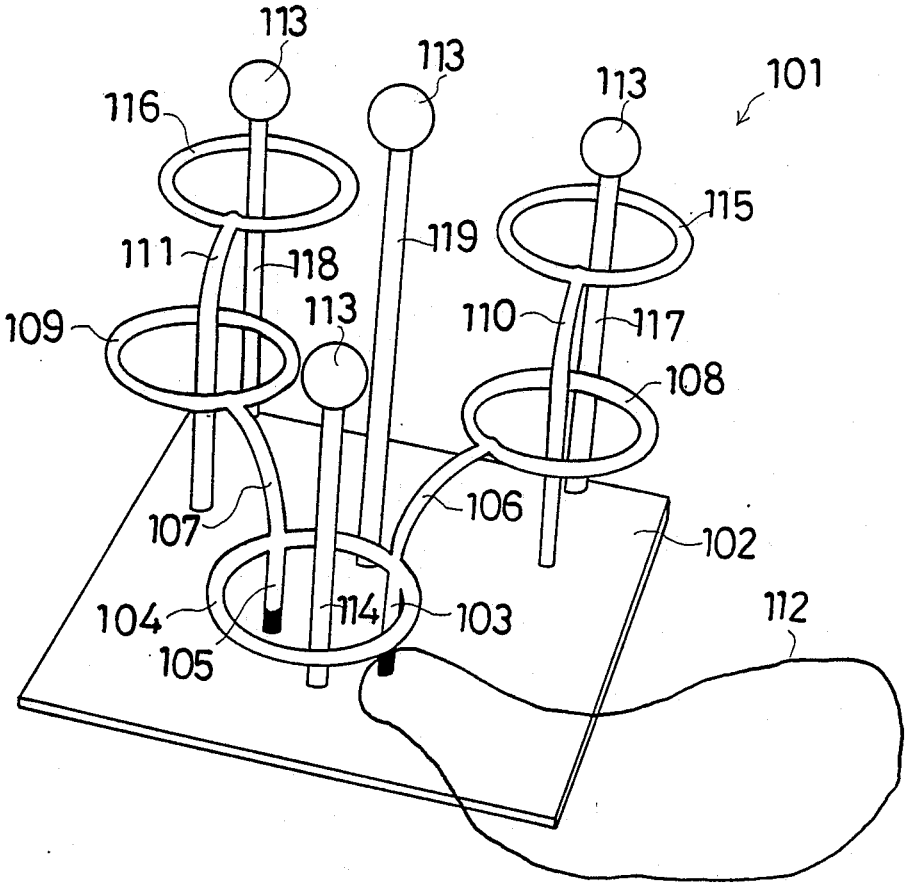
FIG. 21 is a perspective view of a second embodiment of the second improvement.

Shown in FIG. 21 is a second embodiment of the second improvement in which the third and fourth obstruction pins 110, 111 which extend through the insides of the second and third annular obstructions 108, 109 respectively in the loop transfer game device 101 of the first embodiment, have fourth and fifth annular obstructions 115, 116 fixedly mounted to the distal ends thereof respectively. There are also provided six and seventh obstruction pins 117, 118 extending through the insides of the fourth and fifth annular obstructions 115, 116 respectively. A decoration pin 119 is particularly provided for decorative purpose only and of no use in the game. The procedure of transfer of the loop 112 from the first pin 103 to the second pin 105 is the same as of the first embodiment and will be omitted to describe.

According to the second embodiment, the third and fourth obstruction pins 110, 111 may extend straightly and have at the distal ends the fourth and fifth annular obstructions 115, 116 respectively while the six and seventh obstruction pins 117, 118 are curved so as to extend through the insides of the fourth and fifth annular obstructions 115, 116 respectively.

Although the base member 102 on which the first and second pins 3, 5 or 103, 105, the first annular obstruction 4 or 104, and the other annular obstructions and obstruction pins are disposed according to the first or second embodiment, it may be a single member or a group of separate base blocks which are connected in the integral arrangement or respectively mounted on a solid base e.g. of concrete structure. It is preferable that the material of each pin or obstruction is hard systhetic resin, thick metal wire, or the like for use in a table game device and more specifically, thick-walled steel pipes are preferably be employed for installation of an outdoor loop transfer game device of large size according to the present invention providing safety strength in the construction.

I claim:

1. A loop transfer game device comprising a first pin mounted on a base member, a second pin connected to said first pin by a first annular obstruction, a first obstruction pin extending through the inside of said first annular obstruction and having a second annular obstruction mounted to the distal end thereof, a second obstruction pin extending through the inside of said second annular obstruction, and a loop made of flexible material and provided so as to encircle either said first or second pin.

2. A loop transfer game device comprising a first pin mounted on a base member, a second pin mounted on said base member and connected to said first pin by a first annular obstruction, a couple of first and second obstruction pins fixedly mounted to said first annular obstruction, a couple of second and third annular obstructions fixedly mounted to the distal ends of said first and second obstruction pins respectively, a couple of third and fourth obstruction pins extending through the insides of said second and third annular obstructions respectively, and a loop made of flexible material and provided so as to encircle either said first or second pin.

3. A loop transfer game device as defined in claim 2, further comprising a fifth obstruction pin extending through the inside of said first annular obstruction.

* * * * *